US007131453B2

(12) United States Patent
Toji et al.

(10) Patent No.: US 7,131,453 B2
(45) Date of Patent: Nov. 7, 2006

(54) HYDRAULIC VALVE DEVICE AND METHOD FOR ASSEMBLING THE SAME

(75) Inventors: Yutaka Toji, Hiroshima (JP); Hidekazu Oka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 23 days.

(21) Appl. No.: 10/821,950

(22) Filed: Apr. 12, 2004

(65) Prior Publication Data

US 2004/0211471 A1 Oct. 28, 2004

(30) Foreign Application Priority Data

Apr. 23, 2003 (JP) ..... 2003-119007

(51) Int. Cl.
*F15B 13/043* (2006.01)

(52) U.S. Cl. ..... 137/15.18; 137/269; 137/596.12

(58) Field of Classification Search ..... 137/15.18, 137/269, 596, 596.12; 60/421; 91/54
See application file for complete search history.

(56) References Cited

U.S. PATENT DOCUMENTS 3,204,662 A 9/1965 Williams
5,138,837 A 8/1992 Obertrifter et al.
6,430,922 B1 8/2002 Tohji

FOREIGN PATENT DOCUMENTS

| | | |
|---|---|---|
| EP | 0 190 431 | 8/1986 |
| EP | 1 253 327 | 10/2002 |
| JP | 10-25770 | 1/1998 |

*Primary Examiner*—Stephen M. Hepperle
(74) *Attorney, Agent, or Firm*—Oblon, Spivak, McClelland, Maier & Neustadt, P.C.

(57) ABSTRACT

An option valve for controlling the operation of an option actuator added as an option is installed into each of first and second main valve blocks in each of which plural control valves, a pressure oil supply line connected to a pump and a tank line connected to a tank are incorporated, and plural types of connection blocks incorporating circuit elements to be added to the option valve are attached to the main valve blocks selectively to constitute a hydraulic valve device. According to this hydraulic valve device, it is possible to widely cope with various option attachments despite a built-in system with the option valve incorporated beforehand in the main valve blocks.

15 Claims, 3 Drawing Sheets

HYDRAULIC VALVE DEVICE AND METHOD FOR ASSEMBLING THE SAME

BACKGROUND OF THE INVENTION

1. Field of the Invention

The present invention relates to a hydraulic valve assembly installed in a hydraulic working machine and a method for assembling the same.

2. Description of the Related Art

Control valves used in a hydraulic excavator are usually divided into two groups, which are installed into two separate main valve blocks. In both main valve blocks, there are respectively disposed pressure oil supply passages for conducting pressure oil from first and second pumps as pressure oil sources in the main valve blocks to the control valves.

In addition to a standard specification, an option attachment such as a crusher or a breaker is sometimes attached to the hydraulic excavator. In this case, an option actuator for the option attachment and an option valve for controlling the operation of the option actuator are needed.

In a method wherein an option valve unit comprising the option valve and a circuit element connected hydraulically to the option valve unit is installed into a main valve block, the option actuator is connected to an actuator port formed in the main valve block.

An affixing method wherein a connection block with an option valve and a related circuit element incorporated therein is attached to a main valve block is disclosed, for example, in Japanese Unexamined Patent Publication No. Hei 10-25770.

However, in the former method, since there is obtained only one function that the built-in option valve unit possesses, it is impossible to cope with various option attachments different in function and purpose of use. For example, in the case where an actuator for an option attachment requires a large flow rate, it has so far been impossible to meet various users' demands, including a demand for joining discharge oil from both pumps and feeding the resulting confluent oil to an option actuator and a demand for limiting pressure due to a low working pressure of an option actuator.

On the other hand, according to the latter affixing method, since an option valve and a related circuit element are integrated to constitute a connection block, connection blocks with option valve must be provided and replaced by the number corresponding to the number of required functions (circuit elements). Consequently, not only the cost is very high but also the connection blocks are large-sized and heavy, thus giving rise to the problem that the replacing work is troublesome.

SUMMARY OF THE INVENTION

It is an object of the present invention to provide a hydraulic valve assembly as a hydraulic valve device and a method for assembling the same which, despite the adoption of a built-in style, can easily cope with various types of option attachments and required functions at low cost.

The hydraulic valve assembly according to the present invention basically comprises a main valve block as main valve assembly in which plural control valves, a pressure oil supply line connected to a pump, and a tank line connected to an oil tank are incorporated, and an end cover attached to a side face of the main valve block. The main valve block comprises an option valve disposed adjacent the end cover to control the operation of an option actuator, a pressure oil supply passage which connects the option valve and the pressure oil supply line with each other, a return passage which connects the option valve and the tank line with each other, an actuator passage to which the option actuator is connected, a check valve for preventing reverse flowing of pressure oil from the pressure oil supply passage to the pressure oil supply line, a pressure oil branch passage branching from the pressure oil supply passage and provided at a front end thereof with a pressure oil branch port which is closed with the end cover, a return branch passage communicating with the tank line and provided at a front end thereof with a return branch port which is closed with the end cover, and an actuator branch passage branching from the actuator passage and provided at a front end thereof with an actuator branch port which is closed with the end cover.

The method for assembling a hydraulic valve assembly according to the present invention basically comprises the steps of installing an option valve for controlling the operation of an option actuator into a side face of a main valve block to which side face an end cover is attached, with plural control valves, a pressure oil supply line connected to a pump and a tank line connected to an oil tank being incorporated in the main valve block, and then attaching a predetermined connection block selectively to the main valve block in accordance with a function of the option valve out of plural types of connection blocks connected hydraulically to the option valve and incorporating circuit elements therein.

Thus, at the time of mounting an option attachment after incorporation of the option valve into the main valve block, a connection block having a circuit element conforming to the type of the option attachment and a required function (e.g., confluence function, confluence switching function, relief function, or tank direct-connecting function) is attached to the main valve block with use of pressure oil branch, return branch and actuator branch passages provided in the main valve block. Thus, despite the built-in system, it is possible to widely cope with various demands related to option attachments.

Moreover, since each connection block is of a construction having only such a circuit element as conforms to the type of an option attachment and a required function, the cost is much lower and connection blocks are reduced in both size and weight, thus permitting a replacement work to be done in a simple manner, as compared with the case where connection blocks with built-in option valve are replaced.

The present invention is applicable to both a hydraulic valve assembly of a monovalve structure having one main valve block and a hydraulic valve assembly of a composite block structure wherein two main valve blocks are coupled together back to back.

DESCRIPTION OF THE PREFERRED EMBODIMENTS

Hydraulic valve assemblies and method for assembling the same according to embodiments of the present invention will be described hereinunder with reference to FIGS. 1 to 7 which are related to the embodiments.

Reference will be made below to a hydraulic excavator as an example of a construction machine.

Further, reference will be made below to hydraulic valve assemblies each having a composite block structure as examples to which the invention is applied.

Figure 1:
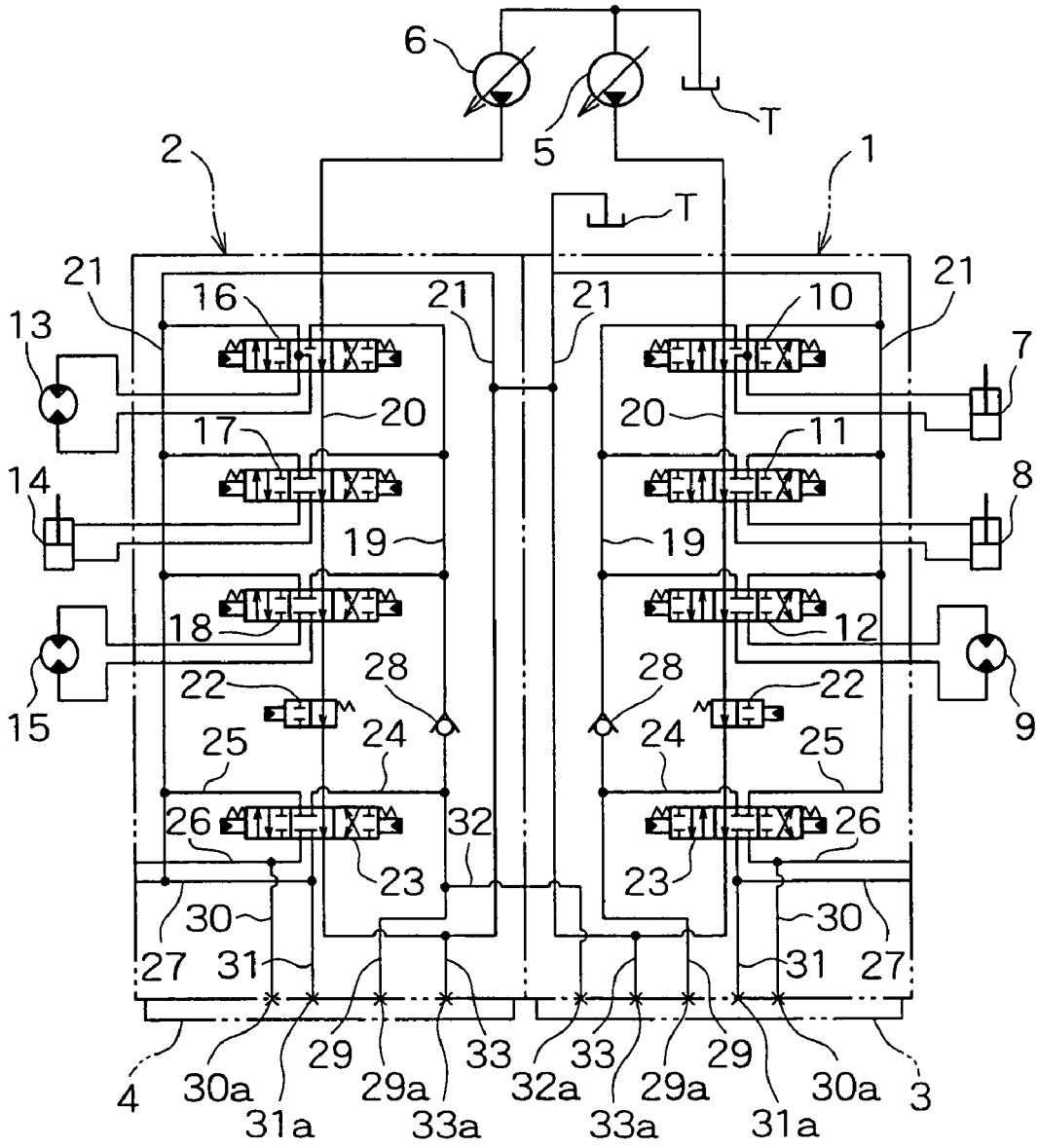
FIG. 1 is an entire hydraulic circuit diagram of a hydraulic valve assembly according to an embodiment of the present invention.

As shown in FIG. 1, a main valve block is composed of a first main valve block 1 and a second main valve block 2. Both main valve blocks 1 and 2 are coupled together back to back, with end covers 3 and 4 being attached respectively to side faces (end faces) of the main valve blocks.

Into both main valve blocks (hereinafter referred to simply as "valve blocks") 1 and 2 there are installed plural control valves which employ first and second pumps 5, 6 respectively as pressure oil sources to control the operation of plural hydraulic actuators, and oil passages for operating the actuators.

More specifically, in the first valve block 1, there are disposed, successively from an upstream side, a control valve 10 for boom cylinder, a control valve 11 for a bucket cylinder, and a control valve 12 for right-traveling motor, to control the operations of a boom cylinder 7, a bucket cylinder 8, and a right-traveling motor 9, respectively.

In the second valve block 2, there are disposed, successively from an upstream side, a control valve 16 for swing motor, a control valve 17 for arm cylinder, and a control valve 18 for left-traveling motor, to control the operations of a rotating motor 13, an arm cylinder 14, and a left-traveling motor 15, respectively.

As elements common to both valve blocks 1 and 2, a pressure oil supply line 19 for supplying a pressure oil, a center bypass line 20, a tank line 21, and a center bypass control valve 22 are installed in each of the valve blocks 1, 2. The center bypass control valve 22 has a function of opening and closing the center bypass line 20. Pressure oil supply lines 19, 19 are port-connected to the first and second pumps 5, 6, respectively, and each tank line 21 is port-connected to a tank T.

Actually, various accessory elements such as relief valve and check valve for each control valve are installed into the valve blocks 1 and 2 and the circuit configuration is more complicated. However, the illustration and explanation of such accessory elements and actual circuit configuration are here omitted for the purpose of simplification.

In this hydraulic valve assembly, option valves 23 are installed on most downstream sides (the sides where end covers 3 and 4 are attached) respectively in the valve blocks 1 and 2. In the case where an actuator as an option actuator for an option attachment such as a crusher or a vibratory breaker is added, the option valve 23 in each of the valve blocks 1, 2 to which the option attachment is attached is used as a control valve for the option actuator.

In each of the option valves 23, there are provided a pressure oil supply passage 24 connected to the pressure oil supply line 19, a return passage 25 connected to the tank line 21, and actuator passages 26 and 27 for connection to the option actuator.

Thus, this hydraulic valve assembly adopts a built-in method wherein the option valves 23 are installed beforehand into the valve blocks 1 and 2.

More specifically, this hydraulic valve assembly adopts a construction wherein, according to a standard specification, an option valve unit comprising an option valve and a circuit element connected hydraulically to the option valve (e.g., a check valve) is installed into a main valve block, and at the time of mounting an option attachment, the option attachment is connected to an actuator port formed in the valve block.

In accordance with this built-in method, the hydraulic valve assembly is constructed as follows.

(i) In the valve blocks 1 and 2, check valve 28 for preventing reverse flowing the pressure oil are disposed upstream of the option valves 23 in the pressure oil supply lines 19. Pressure oil branch passages 29 are disposed downstream of the check valves 28 toward the end covers 3 and 4 (side faces of the blocks), and in normal or steady condition (when no option attachment is used), pressure oil branch ports 29*a* formed at front ends of the pressure oil branch passages 29 are closed with the end covers 3 and 4.

(ii) Actuator branch passages 30 and 31 are formed as branches from the actuator passages 26 and 27. Actuator branch ports 30a and 31a formed at front ends of the passages 30 and 31 are closed with the end covers 3 and 4.

(iii) A confluent passage 32 is disposed in such a manner to span the valve blocks 1 and 2 and an upstream end thereof is connected to the pressure oil branch passage 29 in the second valve block 2, while a downstream end (confluent port) 32*a* thereof is open to a side face of the first valve block 1 and is normally (when no option attachment is used) closed with the end cover 3.

(iv) Return branch passages 33 communicating with the tank lines 21 are formed in the valve blocks 1 and 2. Front ends (return branch ports) 33*a* of the passages 33 are open to side faces of the blocks 1, 2 and are normally closed with the end covers 3 and 4.

In the above construction, when an option attachment is to be used, it is mounted in accordance with the following procedure. First, one end cover of any of the valve blocks 1 and 2 to which the option actuator is to be connected is removed. Next, a connection block having a circuit element conforming to the type of the actuator and to a required function is attached to the side face of the valve block in a hydraulically connected state to the option valve 23.

In this way there is established a construction wherein a connection block having a circuit element connected hydraulically to the option valve 23 is attached to a main valve block in the hydraulic valve assembly.

The following description is now provided about option attachment variations.

(a) With Confluence/Relief Function:

In the case where the actuator for an option attachment requires a large flow rate of pressure oil (e.g., a crusher cylinder), it is required that pressure oil from both first and second pumps 5, 6 or both pumps 5, 6 plus a third pump be joined and the resulting confluent flow be supplied to the actuator. In this case, the use of such a connection block 34 as shown in FIG. 2 is suitable.

The oil from the third pump as an additional pump is also added for the option actuator. Thus, it is possible to cope with the case where an option actuator requires an extremely large flow rate.

Figure 2:
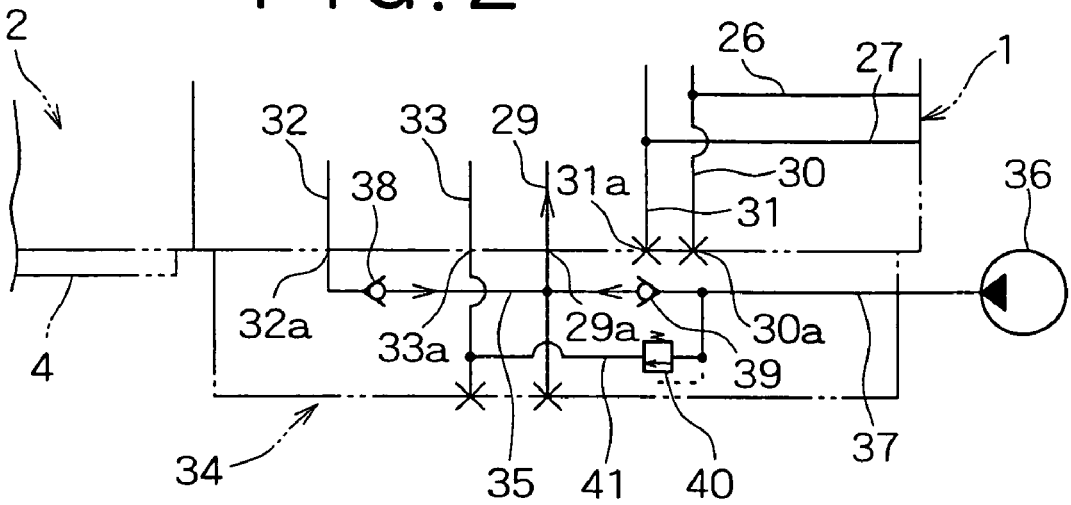
FIG. 2 is a circuit diagram in a state in which a connection block for adding a confluence function is attached to the hydraulic valve assembly.
Figure 3:
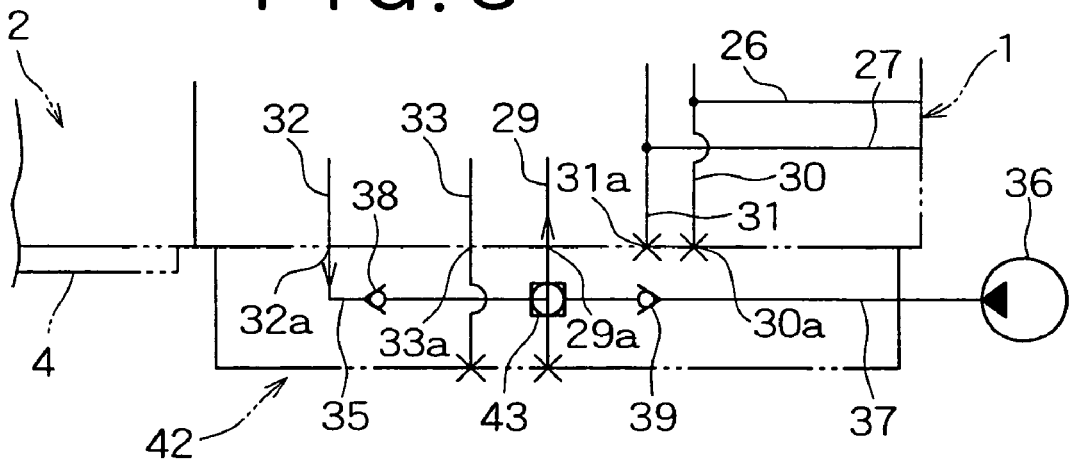
FIG. 3 is a circuit diagram in a state in which a connection block for adding a confluence switching function is attached to the hydraulic valve assembly.

FIG. 2 shows an example in which an option actuator is connected to the first valve block 1.

The connection block 34 is attached to the side face of the first valve block 1 as an end cover having a confluence function in place of the standard end cover 3.

In the connection block 34 thus serving also as an end cover there are formed a confluence connection passage 35 and a third pump passage 37 connected to a third pump 36.

The third pump passage 37 formed in the connection block 34 conducts pressure oil from the third pump 36 to the confluence connection passage 35.

The confluence connection passage 35 is formed in such a state as connects the confluence passage 32 and the pressure oil branch passage 29 in the first valve block 1 with each other through respective ports 32*a* and 29*a*. The third pump passage 37 is connected to the confluence connection passage 35.

Check valves 38 and 39 for preventing reverse flow of a pressure oil are disposed in the confluence connection passage 35 and the third pump passage 37, respectively.

Further, a confluence return passage 41 equipped with a relief valve 40 is connected to the third pump passage 37 and is also connected to the return branch passage 33 in the first valve block 1.

Thus, within the connection block 34, the confluence return passage 41 communicating with the return branch port 33*a* is provided, and the relief valve 40 is disposed between the confluence return passage 41 and the third pump passage 37.

Since the relief valve 40 is installed into the connection block 34, a working pressure of the option actuator can be limited to a pressure matching the delivery pressure of the third pump 36. That is, a relief function can be added easily at low cost.

With the connection block 34, pressure oil from the second valve block 2 (second pump 6) and the third pump 36 joins together and the resulting confluent oil is fed to the pressure oil branch passage 29. Further, the pressure oil from the first pump 5 joins the confluent oil and the resulting confluent oil is fed to the option actuator via the option valve 23.

In this way, a confluence function required in case of adding an option actuator which requires a large flow rate of pressure oil can be ensured easily at low cost.

Besides, in the hydraulic valve assembly of a composite block structure, despite the connection block 34 being attached to a side face of the first valve block (one valve block) 1, it is possible to let the pressure oil from the second pump oil for the second valve block 2 (the other valve block) join the pressure oil associated with the first valve block. Therefore, machining of the valve blocks 1 and 2 and mounting of the connection block 34 are easier than in case of mounting the connection block 34 so as to span both valve blocks 1 and 2.

Further, with the relief valve 40, the working pressure of the option actuator can be limited to a pressure matching the delivery pressure of the third pump 36. That is, a relief function can also be obtained.

(b) With Confluence Switching Function:

In the case where plural types of option actuators different in required flow rate of pressure oil are used selectively, it is required to make switching from one flow rate to another. In this case, as is the case with the above (a), the standard end cover 3 is removed and a connection block 42 shown in FIG. 3 which also serves as an end cover is mounted.

In the connection block 42, as is the case with the connection block 34 shown in FIG. 2, there are provided, as circuit elements for confluence, a confluence connection passage 35 with check valve 38 and a third pump passage 37 with check valve 39.

Moreover, as a circuit element unique to the connection block 42, a confluence switching valve 43 is disposed at a connection point (confluent point) among the confluence connection passage 35, the third pump passage 37 and the pressure oil branch passage 39. With the confluence switching valve 43, the state of confluence is switched over at a confluent point of pressure oil in the confluence connection passage 35. More specifically, switching is made among the state (two-pump confluence) in which only the second pump oil from the second valve block 2 is joined to the pressure oil branch passage 29, the state (three-pump confluence) in which the third pump oil is allowed to join the second pump confluence, and the state (single flow by a single pump) free of confluence.

Thus, switching can be made between a confluent flow and a single flow, or among three-pump flows, i.e., all-pump confluence/two-pump confluence/single flow.

As the confluence switching valve 43 there may be used such a manual change-over valve as illustrated or there may be used a pilot change-over valve which is operated with an external hydraulic or electric signal.

(c) With Tank Direct-Connecting Function:

For example, in case of using a breaker as an option attachment, if return oil from an option actuator, which contains a pulsating component, is returned to the tank T via a valve block, devices such as an oil cooler seem to be damaged. In such a condition, it is desired that a state of direct return of the return oil to the tank T is selected.

Figure 4:
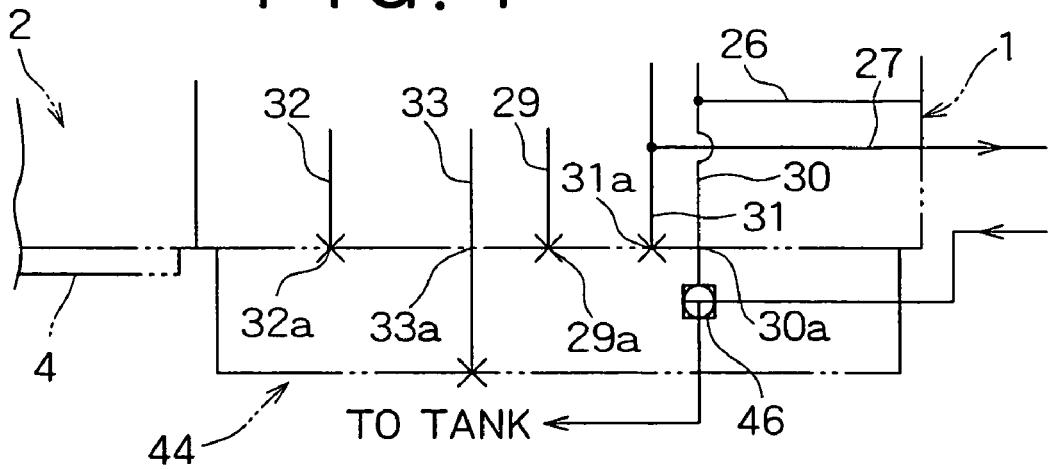
FIG. 4 is a circuit diagram in a state in which a connection block for adding a tank direct-connecting function is attached to the hydraulic valve assembly.
Figure 5:
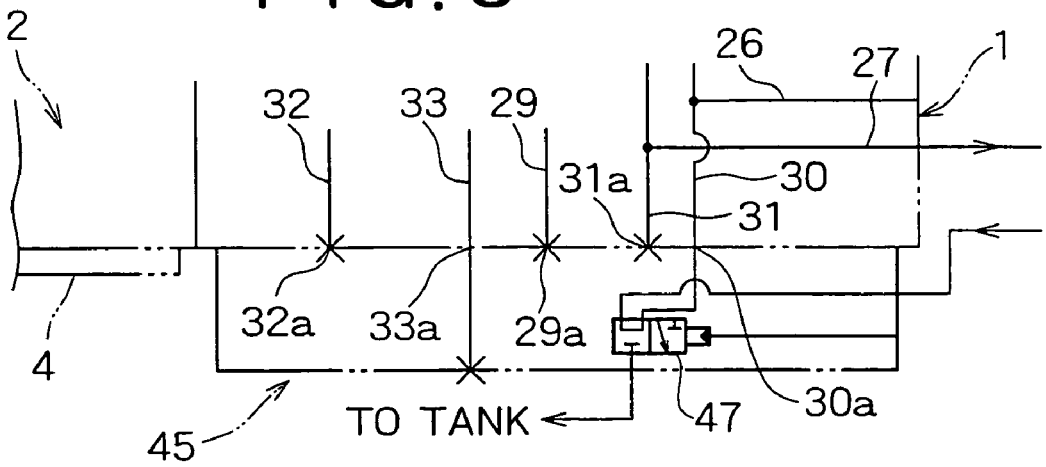
FIG. 5 is a circuit diagram showing a variation of FIG. 4.

In this case, a connection block 44 shown in FIG. 4 which also serves as an end cover or a connection block 45 shown in FIG. 5 which also serves as an end cover is attached to a side face of a valve block.

In the connection blocks 44 and 45 there are provided return direction switching valves 46 and 47, respectively. With the switching valves 46 and 47, switching can be made between a state in which return oil from an option actuator is returned to the actuator branch passage 30 in the first valve block 1 and a state (position) in which the return oil is returned directly to the tank T.

An manual switching valve and a pilot switching valve adapted to be operated with an external pilot oil pressure which may be an electric signal are used as the return direction switching valve 46 in the connection block 44 shown in FIG. 4 and as the return direction switching valve 47 in the connection block 45 shown in FIG. 5, respectively.

In this case, the return oil which contains a pulsating component may be returned directly to the tank T as necessary to prevent damage of devices.

Thus, in case of using a breaker as an option attachment, return oil from an option actuator, which contains a pulsating component, can be returned directly to the tank, whereby it is possible to prevent damage of devices such as an oil cooler. That is, a tank direct-connecting function can be added easily at low cost.

Besides, since the return direction switching valves 46 and 47 are incorporated in the connection blocks (end covers) 44 and 45, they can be installed in a simple manner and at low cost as compared with the case where the switching valves 46 and 47 are installed outside.

(d) With Relief Function:

In the case where the working pressure of an option actuator is lower than that of the standard actuator, it is required to provide a pressure limiting function.

Figure 6:
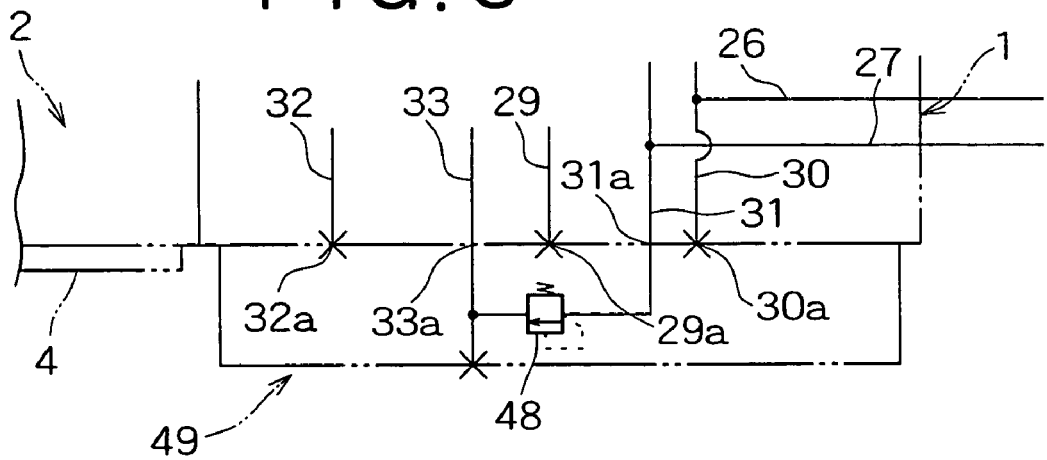
FIG. 6 is a circuit diagram in a state in which a connection block for adding a relief function is attached to the hydraulic valve assembly.

In this case, as shown in FIG. 6, the requirement can be met by attaching a connection block 49 which also serves as an end cover to a side face of a valve block, the connection block 49 having a relief valve 48 for which there is set a pressure matching the working pressure of the option actuator.

According to this construction, the relief valve 48 which limits the working pressure of the option actuator is disposed as a circuit element within the connection block 49.

Thus, the relief function for limiting the working pressure of the option actuator can be obtained easily at low cost by the connection block.

OTHER EMBODIMENTS (1) Although in the construction of the first embodiment described above the confluent oil is fed to the first valve block 1, there may be adopted a construction wherein the confluent oil is fed to the second valve block 2.

Figure 7:
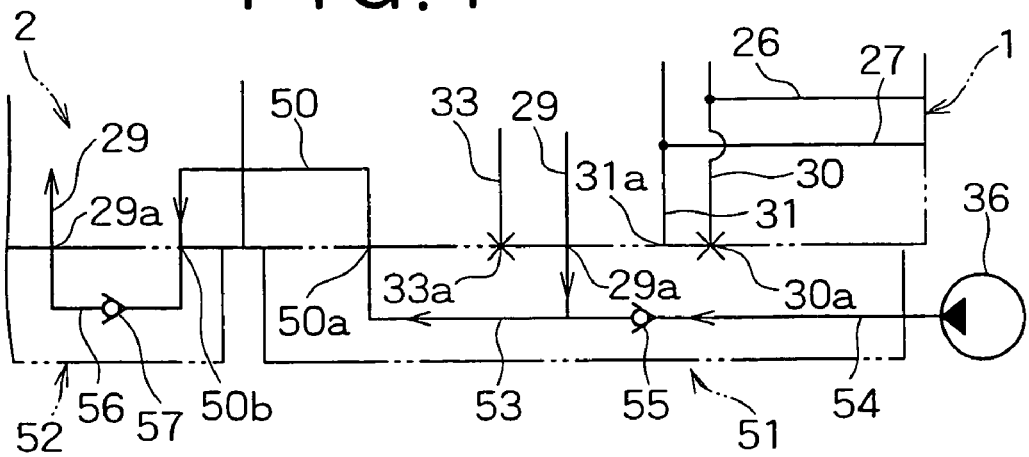
FIG. 7 is a hydraulic circuit diagram of a part of a hydraulic valve assembly according to a second embodiment of the present invention.

More specifically, as shown in FIG. 7, a confluence passage 50 is disposed so as to span the valve blocks 1 and 2 and in a state in which confluent ports 50*a* and 50*b* formed at both ends of the confluence passage 50 are open to the respective end cover sides, and in the case where confluence is required, first and second connection blocks 51, 52 for confluence, which also serve as end covers, are attached to the valve blocks 1 and 2, respectively.

In the first block 51, as is the case with the connection block 34 shown in FIG. 2, there are provided a confluence connection passage 53 and a third pump passage 54 connected to the third pump 36.

However, unlike the connection block 34, a check valve 55 for preventing reverse flow is disposed in only the third pump passage 54.

In the second connection block 52, there is provided a second confluence connection passage 56 for connection between the confluence passage 50 and the pressure oil branch passage 29 in the same block, and in the passage 56 there is provided a check valve 57 which permits only the flow of oil toward the pressure oil branch passage 29.

According to this construction, the oil on the first valve block 1 side (the oil from the first pump 1) and the third pump oil join together and the resulting confluent oil is fed to the second valve block 2 side.

As the second connection block 52 there may be used a connection block free of the check valve 57 in the second confluence connection passage 56. In this case, a confluent oil including the third pump oil is fed in the valve blocks 1 and 2.

(2) For example, in the case of an option attachment having two actuators, there may be used a connection block with a second option valve and related circuit elements incorporated therein.

In this case, there may be adopted a construction wherein the second option valve is attached to the first valve block 1 for example and pressure oil is supplied from the second valve block 2 side.

(3) According to the construction of the embodiment described above, a connection block which also serves as an end cover is attached to a valve block. Since the end cover thus serves also as the connection block, it is possible to reduce the size and cost of the device structure. Of course, there may be adopted a construction wherein a dedicated connection block is attached to a valve block and an end cover is mounted outside the connection block.

(4) Although the hydraulic valve assembly of the above embodiment is of a composite block structure wherein two valve blocks 1 and 2 are coupled together, the present invention is also applicable to a hydraulic valve assembly of monoblock structure having only one valve block.

Although the invention has been described with reference to the preferred embodiments in the attached figures, it is noted that equivalents may be employed and substitutions made herein without departing from the scope of the invention as recited in the claims.

We claim:

1. A hydraulic valve device comprising:

a main valve block in which control valves, a pressure oil supply line connected to a pump, and a tank line connected to an oil tank are incorporated; and an end cover attached to a side face of said main valve block, said main valve block further comprising:

an option valve disposed adjacent said end cover adapted to control the operation of an option actuator;

a pressure oil supply passage which connects said option valve and said pressure oil supply line with each other;

a return passage which connects said option valve and said tank line with each other;

an actuator passage to which said option actuator is connected;

a check valve for preventing reverse flowing of pressure oil from said pressure oil supply passage to said pressure oil supply line;

a pressure oil branch passage branching from said pressure oil supply passage and provided at a front end of said pressure oil branch passage with a pressure oil branch port which is closed with said end cover;

a return branch passage communicating with said tank line and provided at a front end of said return branch passage with a return branch port which is closed with said end cover; and an actuator branch passage branching from said actuator passage and provided at a front end of said actuator branch passage with an actuator branch port which is closed with said end cover.

2. The hydraulic valve device according to claim 1, wherein said pump comprises a first pump and a second pump, and said main valve block comprises a first main valve block which uses said first pump as a pressure oil source and a second main valve block which uses said second pump as a pressure oil source.

3. The hydraulic valve device according to claim 2, wherein said first main valve block and said second main valve block are coupled together in a state in which respective rear sides of the main valve blocks are in contact with each other, said end cover is attached to a side face of each of said first and second main valve blocks, said option valve disposed adjacent said end cover, said pressure oil supply passage, said return passage, said actuator passage, said check valve, said pressure oil branch passage, said return branch passage, and said actuator branch passage are provided within one of said main valve blocks, and a confluence passage for joining pressure oil within both said main valve blocks is disposed through both said main valve blocks, said confluence passage being closed with said end cover.

4. The hydraulic valve device according to claim 1, further comprising a connection block attached to said main valve block, with a circuit element being incorporated in said connection block, said circuit element being hydraulically connected to said option valve.

5. The hydraulic valve device according to claim 3, further comprising a connection block attached to one of said first and second main valve blocks, with a circuit element being incorporated in said connection block, said circuit element being hydraulically connected to said option valve.

6. The hydraulic valve device according to claim 5, wherein within said connection block there is provided as said circuit element a confluence connection passage for connection between said confluence passage and said pressure oil branch passage.

7. The hydraulic valve device according to claim 6, wherein within said connection block there is provided a third pump passage for conducting pressure oil from a third pump to said confluence connection passage.

8. The hydraulic valve device according to claim 7, wherein within said connection block there is provided a confluence return passage communicating with said return branch port, and a relief valve is disposed between said confluence return passage and said third pump passage.

9. The hydraulic valve device according to claim 6, wherein a confluence switching valve for switching from one confluent state to another is disposed at a confluent point of pressure oil in said confluence connection passage.

10. The hydraulic valve device according to claim 5, wherein within said connection block there is provided as said circuit element a return direction switching valve for switching the direction of return oil from said option actuator between a position for conducting the return oil to said actuator branch passage and a position for conducting the return oil directly to said tank.

11. The hydraulic valve device according to claim 6, wherein within said connection block there is provided as said circuit element a relief valve for limiting a working pressure of said option actuator.

12. The hydraulic valve device according to claim 4, wherein said circuit element is incorporated in said end cover, and in this state said end cover is attached as said connection block to said main valve block.

13. The hydraulic valve device according to claim 5, wherein said circuit element is incorporated in said end cover, and in this state said end cover is attached as said connection block to said main valve block.

14. The method for assembling the hydraulic valve device of claim 4, comprising the steps of: installing said option valve into the side face of said main valve block to which side face said end cover is attached; and attaching a predetermined connection block selectively to said main valve block in accordance with a function of said option valve out of plural types of connection blocks hydraulically connected to said option valve and incorporating circuit elements.

15. A method for assembling a hydraulic valve device, comprising the steps of:

installing an option valve for controlling the operation of an option actuator into a side face of a main valve block to which side face an end cover is attached, with control valves, a pressure oil supply line connected to a pump and a tank line connected to a tank being incorporated in said main valve block;

providing at least two different types of connection blocks incorporating different circuit elements therein; and attaching a predetermined connection block to said main valve block in accordance with a function of said option valve out of the different types of connection blocks such that a circuit element in the predetermined connection block is hydraulically connected to said option valve.

* * * * *